US005439193A

United States Patent [19]

Coulter et al.

[11] Patent Number: 5,439,193

[45] Date of Patent: Aug. 8, 1995

[54] CONTAINER INVERTING SUPPORT

[75] Inventors: J. Scott Coulter, Elko, Nev.; Samuel J. Gleason, Preston, Id.; Allen R. Thabit, Elko, Nev.

[73] Assignee: Xcel Industrial Group, Elko, Nev.

[21] Appl. No.: 204,894

[22] Filed: Mar. 1, 1994

Related U.S. Application Data

[63] Continuation of Ser. No. 967,444, Oct. 28, 1992, abandoned.

[51] Int. Cl.[6] ..... A47G 29/00

[52] U.S. Cl. ..... 248/206.3; 248/311.3; 248/312; 248/206.4

[58] Field of Search ..... 248/311.3, 312, 311.2, 248/314, 206.5, 205.5, 205.1, 205.7, 206.2, 206.3, 206.4; 222/181

[56] References Cited

U.S. PATENT DOCUMENTS

| | | | |
|---|---|---|---|
| 2,522,912 | 9/1950 | Weiss | 248/311.3 X |
| 3,343,772 | 9/1967 | Howell et al. | 248/205.5 |
| 4,271,878 | 6/1981 | Bologa | 248/311.3 X |
| 4,696,447 | 9/1987 | Strecker | 248/314 X |
| 4,844,480 | 7/1989 | Jasmagy, Jr. | 248/314 X |
| 4,971,209 | 11/1990 | Todd | 248/311.3 X |
| 4,979,708 | 12/1990 | Aoki | 248/206.2 X |
| 5,044,577 | 9/1991 | Spearman | 248/311.2 X |
| 5,067,680 | 11/1991 | Miller | 248/311.3 |
| 5,149,041 | 9/1992 | Hartke | 248/311.3 X |

*Primary Examiner*—Rinaldi I. Rada

*Attorney, Agent, or Firm*—Handal & Morofsky

[57] ABSTRACT

A container inverting support (10) is disclosed for supporting a container (98) having an opening with the opening in a lowered position. This causes material contained in the container to flow toward the opening. The invertor comprises a support member (12) which defines a cup (28) for receiving that portion of the container adjacent to the opening of the container. The passage is configured and dimensioned to support the container (98) with the opening in a lowered position. A suction cup (46) is secured to and extends from a support surface of the support member (12) and attaches the container (98) to a vertical planar surface (44). A separator (64) extends from a surface of the support member and maintains the support member in a position at which the opening of the container is in a lowered position. The inventive container inverting support comprises a passage for supporting a container. The passage comprises a bottom, a side wall and a hole (40). The area of this hole is smaller than the area of the bottom of the passage.

12 Claims, 6 Drawing Sheets

CONTAINER INVERTING SUPPORT

This application is a continuation of application Ser. No. 07/967,444, filed Oct. 28, 1992, now abandoned.

TECHNICAL FIELD

The present invention relates to a container inverting device for supporting bottles containing ketchup, shampoo, or other similar materials for storage in a manner which allows the material to accumulate near the mouth of the bottle, allowing the same to be quickly ejected from the bottle when a quantity of the material is desired.

BACKGROUND

At some point in the dimmest recesses of forgotten antiquity, the beauty, durability, and imperviousness of a heated mixture of sand, soda, and limestone was recognized and the ancients began to fashion vessels of this material. The earliest method of forming glass into useful articles consisted of blowing the glass into a bubble, an operation which naturally formed a vessel mouth and a chamber. Both the mouth and the chamber itself were necessary results of the glass blowing operation which generally involved the use of air pressure to establish a deformation of molten viscous glassy material, usually after an initial mechanical operation establishing starting structures for the glass blowing operation. Upon the application of air pressure to the glass, it is driven outward and, essentially, inflated and expanded to form a bubble which extends around and surrounds the source of air pressure. In the simplest case, this bubble may simply be allowed to harden or may be flattened on the side opposite the mouth through which the air pressure was applied, thus forming a natural bottle shape.

Judging by the archeological record, at a very early point the advantages of adding a neck at the entrance to the chamber formed by the glass blowing bubble was recognized. This structure had the advantage of providing the neck portion of the vessel with increased wall thickness useful in supporting a stopper of wood or other similar material while at the same time providing a surface for easy gripping by a single hand of a user.

Such vessels were a substantial advance in technology when they were first introduced. They allowed one to see the contours of the vessel while at the same time allowing for storage of materials for longer periods of time. More particularly, due to the impermeability of the vessel sidewalls to gas, glass vessels prevented the introduction of oxygen into the vessel and thereby promoted preservation, while at the same time preventing the material on the inside of the vessel from escaping by means of evaporation. At the same time, such vessels had surfaces which were easy to clean and could be effectively sterilized by merely being placed in the sun, a common practice until relatively recently when more energy intensive procedures came into use.

Notwithstanding these advantages, the long neck of glass and similar containers, even today, poses a significant waste problem when such containers are filled with relatively highly viscous materials such as honey, ketchup, maple syrup, sauce and other commonly used foods as well as such non-food materials as shampoo, lotions, and the like.

More particularly, because of the shape of the bottle, which persists to this day in its ancient form, such viscous materials tend to flow to the bottom of the bottle and accumulate there. When only a relatively small amount of material remains in such a bottle, such accumulations tend to be in relatively thin layers. Because of the relatively thin accumulations of such material, the combination of adhesion to the bottle, cohesion within the material and viscosity results in a condition where such material has a natural tendency to remain in place. This condition is reinforced by the absence of fluidic pressure promoted by the contents of the bottle when the bottle is full or very nearly full.

As a consequence, if one wishes to remove the contents of such a bottle filled with a relatively small amount of relatively highly viscous material, the removal of the material is sometimes extremely difficult.

In an effort to address this problem, a number of artifices are employed. One approach is simply to invert the vessel and wait for the material to flow. While such flow times are relatively long, the bottle may be inverted and sometimes delicately balanced to allow material to flow to the inverted top of the vessel. However, this is often a precarious and dangerous thing to do, especially in the case of a glass bottle.

Another approach is to simply store the bottle on its side. However, this approach is only a compromise solution is ineffective unless there is substantially more than a minimal amount of material remaining in the bottle.

In an effort to address such problems, bottle support devices for supporting bottles in an inverted orientation have been proposed. However, such devices have failed to see any widespread employment due to a variety of problems, including stability and adaptability to a range of bottle shapes. Adaptability is no small matter, insofar as such devices are in use only a very small percentage of the time during which the bottle with which they are employed, is used. Moreover, such devices must have a versatility which allows them to be employed in a wide variety of locations where bottles may be used or stored.

SUMMARY OF THE INVENTION

The invention, as claimed, is intended to provide a remedy. It solves the problem of how to support a container in a position which causes the material contained within the container to accumulate at the opening of the container. This solution is of particular importance in that it allows the support system to firmly attach to a vertical surface and is contoured in such a way as not to twist and fall off the vertical surface.

The inventive container inverting support supports a container having an opening with the opening in a lowered position. This causes material contained in the container to flow toward the opening. The invertor comprises a support member which defines a passage for receiving that portion of the container adjacent to the opening of the container. The passage is configured and dimensioned to support the container with the opening in a lowered position.

A suction cup is secured to and extends from a support surface of the support member and attaches the container to a vertical planar surface. A separator extends from a surface of the support member and maintains the support member in a position at which the opening of the container is in a lowered position. The inventive container inverting support comprises a passage for supporting a container. The passage comprises a bottom, a side wall and a hole. The area of this hole is smaller than the area of the bottom of the passage.

The container inverting support is comprised of a light weight hard material and is dimensioned with a thickness of about 0.075 inches. This material is rigid enough to allow the container to firmly attach to a vertical planar surface and also stably support the container. A portion extends from the support surface toward the vertical planar surface. This portion has a thickness which is generally about the same dimension as the distance between the support surface and the suction surface of the suction cup when the suction cup is in its compressed suction gripping configuration.

The suction cup is constructed of a pliant, flexible material. A second suction cup extends a distance from the support surface toward the vertical planar surface. This distance is generally about the same dimension as the distance between the support surface and a suction surface of the suction cup when it is in its compressed suction gripping configuration.

An alternative embodiment of the container inverting support comprises a second suction cup extending a distance from the support surface toward the vertical planar surface in place of a hard separator.

Another alternative embodiment of the container inverting support comprises a support member in a frustro-conical shape.

BRIEF DESCRIPTION OF THE DRAWINGS

One way of carrying out the invention is described in detail below with reference to drawings which illustrate only one specific embodiment of the invention and in which.

BEST MODE FOR CARRYING OUT THE INVENTION

Figure 1:
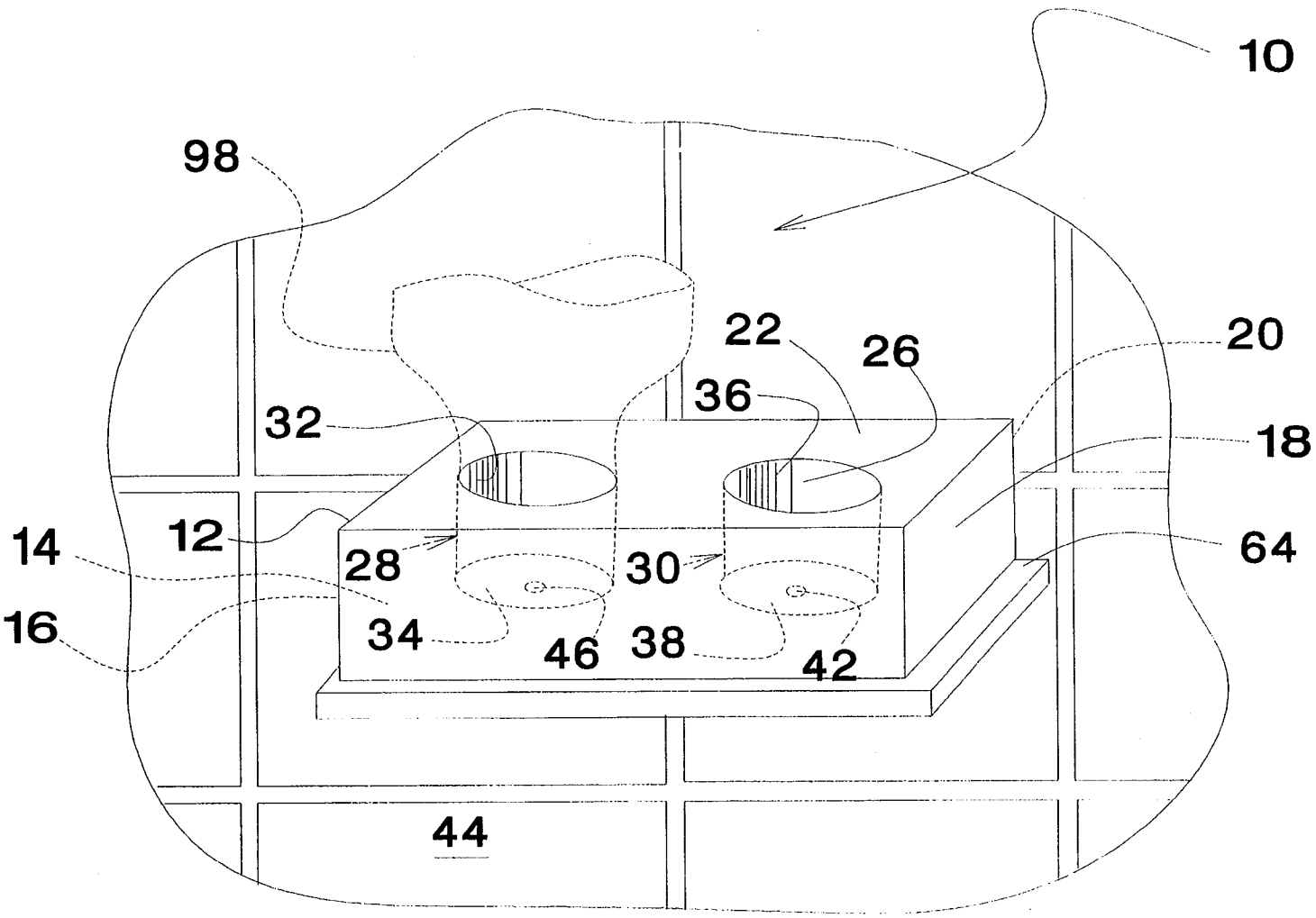
FIG. 1 is a perspective view of container inverting support.
Figure 6:
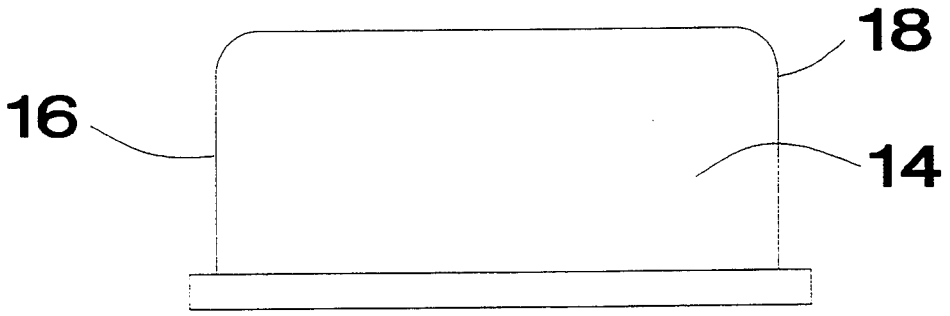
FIG. 6 is a front surface view of container inverting support.
Figure 2:
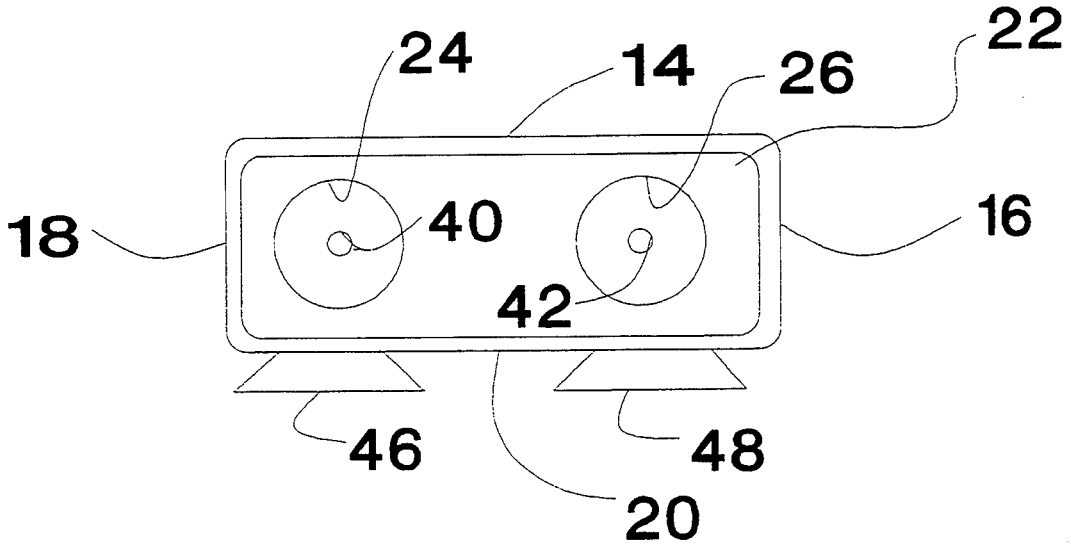
FIG. 2 is a top surface view of container inverting support.
Figure 5:
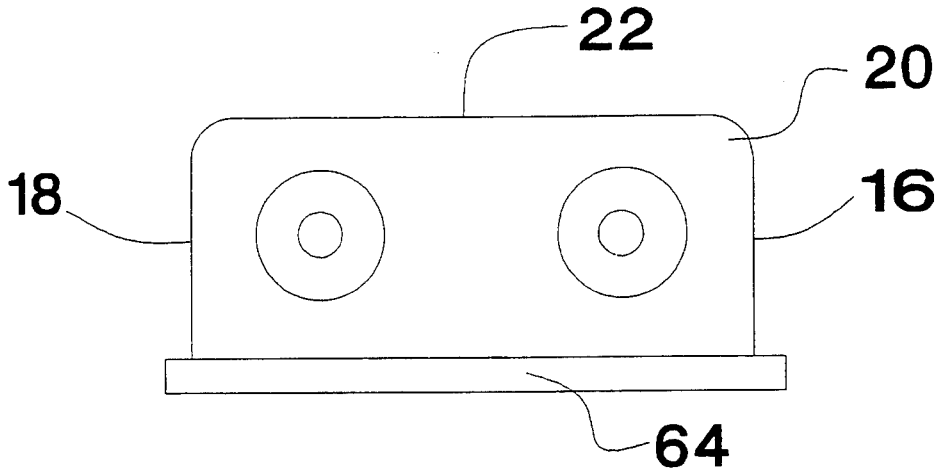
FIG. 5 is a rear side view of container inverting support.

Referring to FIGS. 1–7, a bottle invertor 10 constructed in accordance with present invention is illustrated. Bottle invertor 10 generally comprises a bottomless rectangular solid three dimensional hollow body 12. Body 12 includes a front side 14, a pair of small sides, namely, left side 16 and right side 18, both of which extend between front side 14 and a rear side 20 (FIG. 2).

Front side 14, left side 16, right side 18 and rear side 20 are defined by thin plastic side walls which may be made of any suitable rigid plastic or other suitable material and having a thickness of about 0.075 inches. The body is completed by a top surface 22 which has a pair of holes 24 and 26 defined therein. Holes 24 and 26 are also the openings of a pair of integral cups 28 and 30. Cup 28 generally comprises a cylindrical side wall 32 and a bottom 34. In similar fashion cup 30 comprises a cylindrical side wall 36 and bottom 38. Bottoms 38 and 34, in turn, define holes 42 and 40, respectively in cups 30 and 28. The inventive bottle invertor 10 is secured to a wall or other vertical surface, such as the tiled wall 44 (FIG. 1) of a bathroom stall or other vertical planar surface by a pair of suction cups 46 and 48. Suction cups 46 and 48 are of conventional design passing through holes 50 and 52 in rear side 20.

Figure 7:
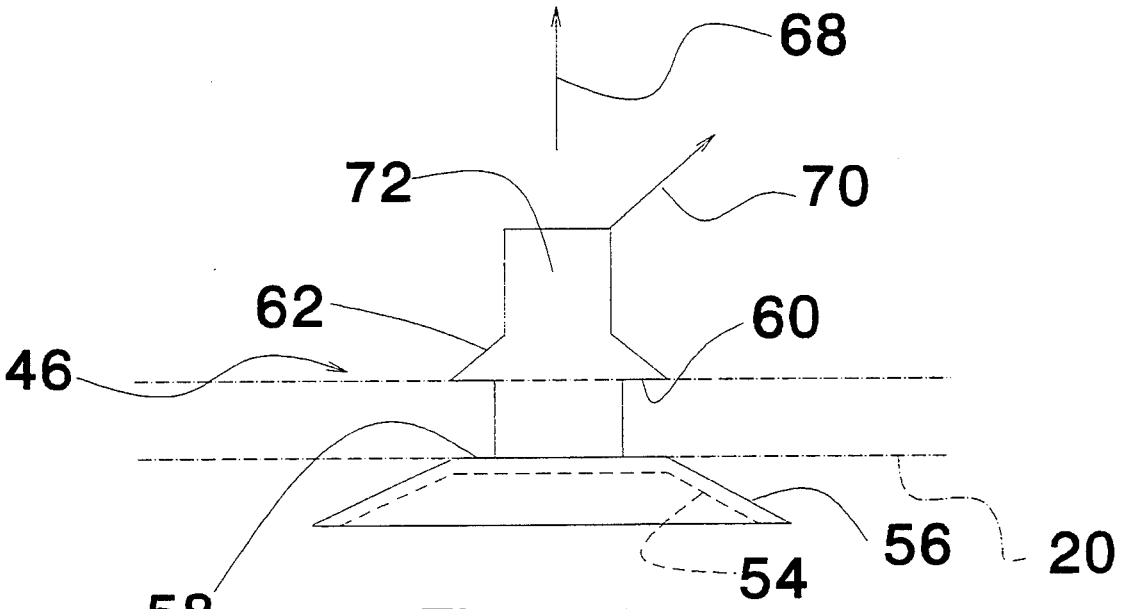
FIG. 7 is a side view of suction cup.

Each of the suction cups 46 and 48 take the form of the suction cup 46 illustrated in FIG. 7. In particular, the suction cup includes a frustro-conical suction surface 54 of a suction member 56. Suction member 56 includes a rear support surface 58 and a locking surface 60. Engagement between suction member 46 and, for example, rear side 20 is accommodated by a frustro-conical ramp surface 62.

Figure 4:
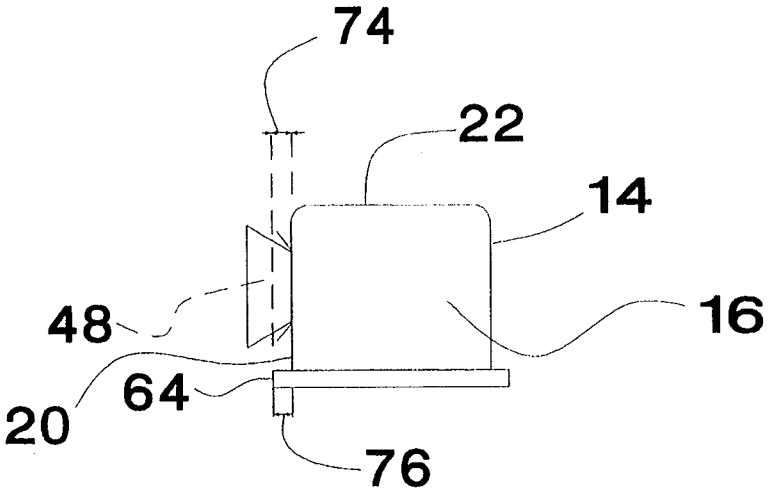
FIG. 4 is a left side view of container inverting support.
Figure 3:
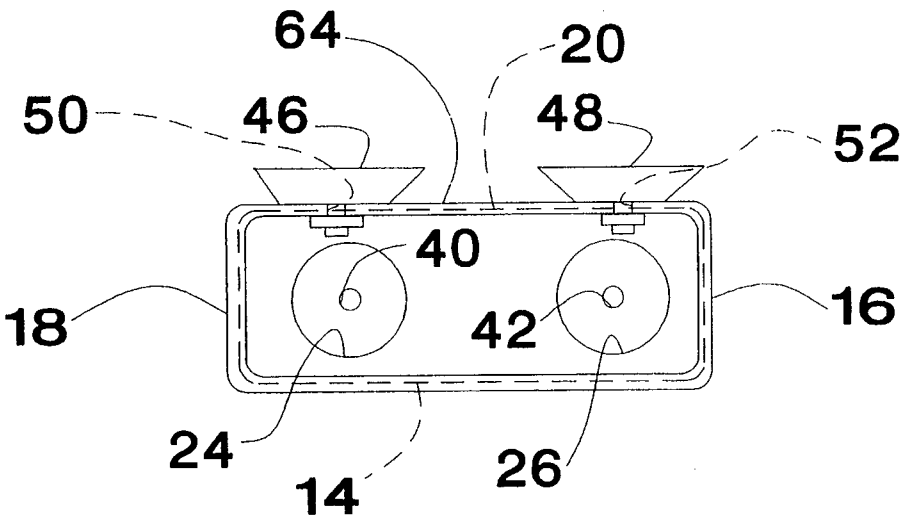
FIG. 3 is a bottom view of container inverting support.

The structure is completed by a rear ledge 64 which contour acts as a separator to prevent easy removal of the suction cup when the inventive bottle invertor is in use. More particularly, removal of a suction cup in the direction indicated by arrow 68 is relatively difficult. However, if a torque is applied to suction cup 46 force in the direction of arrow 70, removal becomes relatively easy. In order to prevent angular displacement of the stem 72 of suction cup 46, during normal load conditions, ledge 64 maintains a separation which results in the rear side 20 being parallel to vertical planar surface 44 during use. As can be seen in FIG. 4, when suction cup 48 is in the compressed suction gripping configuration, the distance 74 between the front of the suction cup and rear side 20 is equal to the width 76 of ledge 64, thus resulting in the maintenance of a parallel relationship between rear side 20 and vertical surface 44.

Figure 8:
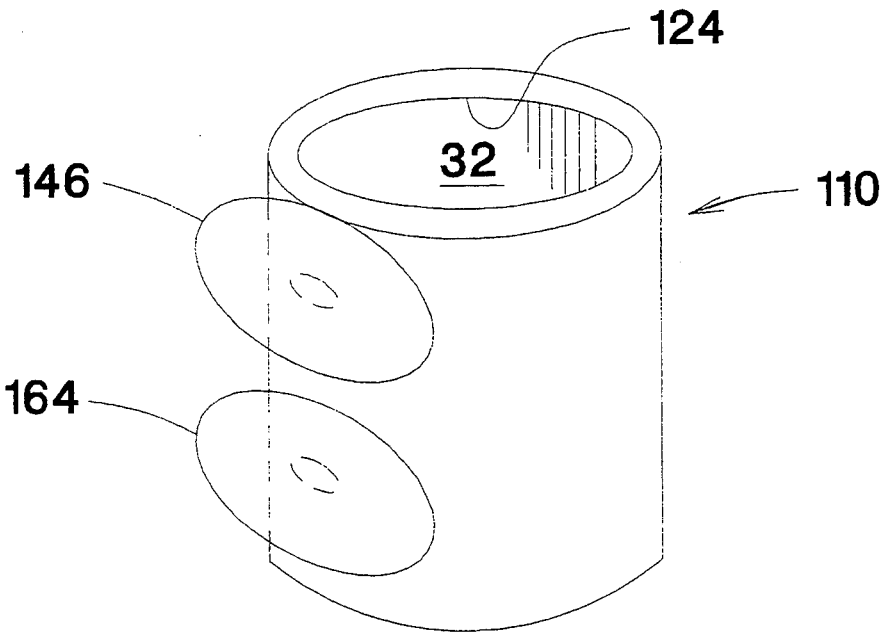
FIG. 8 is a perspective view of cylindrical shaped alternative embodiment of container inverting support.
Figure 9:
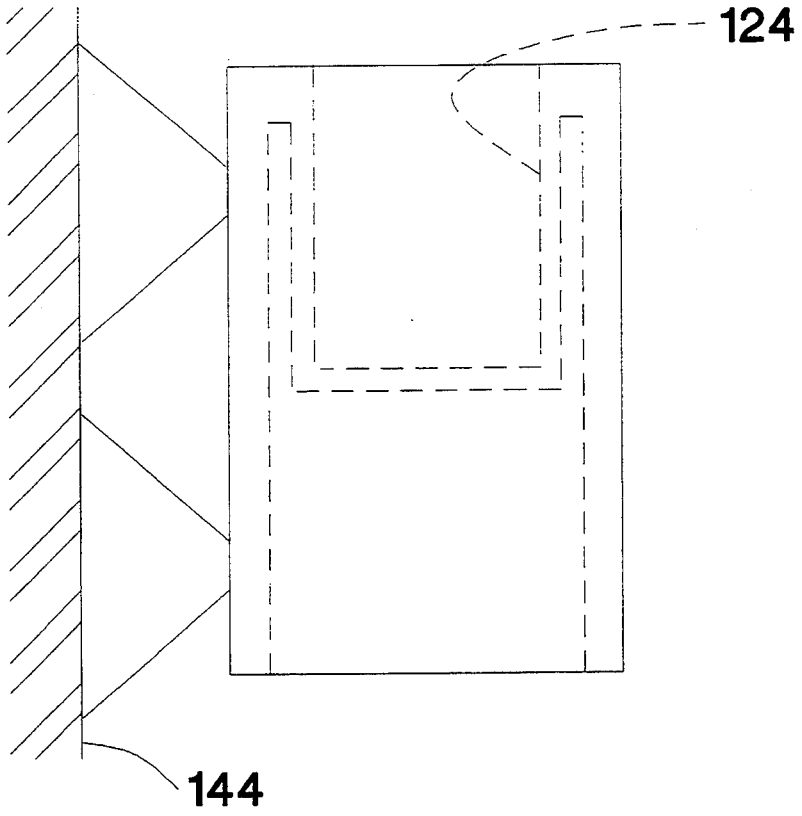
FIG. 9 is a side view of cylindrical shaped alternative embodiment of container inverting support.

An alternative embodiment is illustrated in FIGS. 8–9. Generally, similar parts or parts performing analogous, corresponding or identical functions to those of the FIG. 1–7 embodiment are numbered herein with numbers which differ from those of the earlier embodiment by multiples of one hundred.

More particularly in accordance with this embodiment, the bottle invertor 110, has a body 112, includes a single hole 124 which is defined by cylindrical side wall 132. This invertor, like invertor 10 may be secured to the vertical inside wall 144 of a refrigerator. A suction cup 146 is mounted at the top of the unit while a second suction cup 164 takes the place of ledge 64 in the embodiment of FIGS. 1–7. At the same time, planar rotation of invertor 110 is prevented by use of second suction cup 164. As in the embodiment FIGS. 1–7, the maintenance of even distances between the top and the bottom of invertor 110 results in increased holding ability for suction cups 146 and 164.

Figure 10:
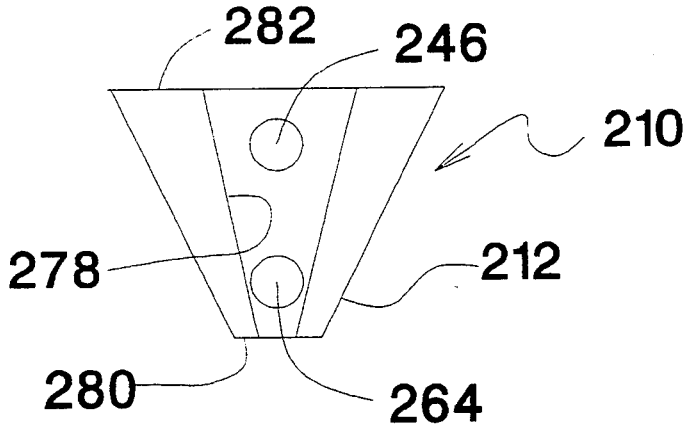
FIG. 10 is front side view frustro conical shaped alternative embodiment of container inverting support.
Figure 11:
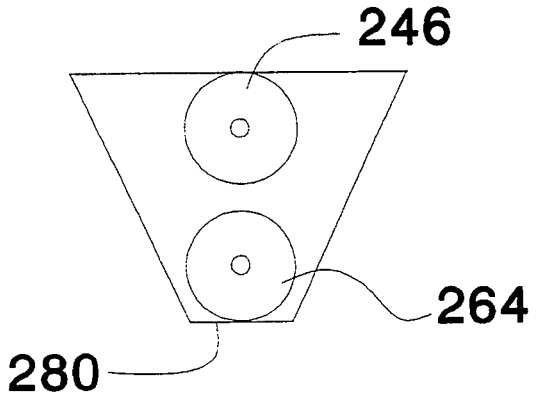
FIG. 11 is a rear side view of frustro conical shaped alternative embodiment of container inverting support.
Figure 12:
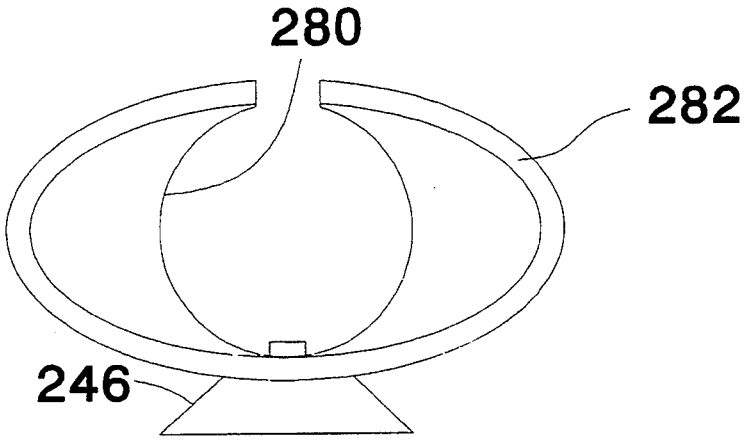
FIG. 12 is a top surface view of frustro conical shaped alternative embodiment of container inverting support.

Still yet another embodiment of the invention is illustrated in FIGS. 10–12. More particularly, in accordance with this embodiment, the bottle invertor 210 comprises a pair of suction cups 246 and 264. The main body 212 of the bottle invertor generally comprises a generally frustro conical shape with a cutaway portion 278 and a base 280 of substantially circular shape and a top 282 of substantially oblong shape. The functioning of the embodiment of FIGS. 10–12 is similar to that of the embodiment of FIG. 8–9 insofar as the use of a ledge, such as ledge 64 is not present and, a suction cup 264 is employed.

In use, the inventive bottle invertor support is secured to a vertical planar surface, such as a bathroom shower wall, or the inner side wall of a refrigerator. This is done simply by pressing the suction cups against a vertical surface to secure the inventive support. A bottle 98 or other container is then simply placed therein. In order to achieve good adhesion between the inventive container inverting support and the vertical planar surface, the introduction of water or a thin film of petroleum jelly at the suction surface 54 may be beneficial, as is the case when the bottle is used on a relatively smooth wall. The water or petroleum jelly helps exclude air, between the suction cups and the vertical planar surfaces during the application of the suction cup to the vertical surface thus forming a better seal. However, when the container inverting support is used on tiles or other very smooth or glossy surfaces, water may cause the suction cup to slip under load, and if water has been introduced it is advantageous to allow some evaporation to occur before putting a bottle in the holder. The usefulness of this inventive container support becomes more important when the material within the container deteriorates with time. The inventive support system allows the material to flow toward the opening of the container thus insuring that the material will be used sooner and inhibit the deterioration of the contained material. In addition, if the inventive support system is used in a refrigerator, the refrigerator walls and shelves are particularly well suited for the support system in so far as the walls provide good adhesion for the suction cups and the shelves provide a stable, safe base for the bottom surface of the container inverting support.

While an illustrative embodiment of the invention has been described above, it is, of course, understood that various modifications will be apparent to those of ordinary skill in the art. Such modifications are within the spirit and scope of the invention, which is limited and defined only by the appended claims.

We claim:

1. A container inverting device, for a container having an opening, for supporting said container on a substantially vertical wall at an inverted orientation, said container opening being located, in said inverted orientation, in a position lower than other portions of said container, whereby, in said inverted orientation, material contained in said container flows toward said opening, said container inverting device comprising:

(a) a support member defining a passage for receiving a portion of said container adjacent said opening of said container, said passage being configured and dimensioned to support said container in said inverted orientation;

(b) a suction cup having a suction surface for engaging said substantially vertical wall and compressible to a compressed suction gripping configuration, said suction cup being secured to and extending from a point of attachment on said support member for attaching said support member to said substantially vertical wall at a position which maintains said container in said inverted orientation; and (c) an abutting surface associated with said support member, said abutting surface being positioned on said support member and with respect to said suction cup to provide at a position where said suction cup is subjected to forces substantially parallel to said suction cup when said support member is maintained in a position where said container is in said inverted orientation, said abutting surface extending to provide support from a first position directly underneath said suction cup, wherein said suction cup is in its compressed suction gripping configuration, across to a second position displaced from said first position, wherein said abutting surface is provided by an elongated generally horizontally oriented raised portion of said support member.

2. A container inverting device as in claim 1, wherein said abutting surface is a separator and said separator has a thickness generally about the same dimension as the distance between said support member and said suction surface of said suction cup when said suction cup is in its compressed suction gripping configuration.

3. A container inverting device as in claim 4, wherein said support member comprises a light weight hard material dimensioned with a thickness of about 0.075 inches, said material being substantially rigid to support said container in said inverted orientation.

4. A container inverting device as in claim 2, wherein said suction cup is constructed of a pliant, flexible material.

5. A container inverting device as in claim 2, wherein said support member comprises a frustro-conical shape.

6. A container inverting device as in claim 1, wherein said passage is defined by a side wall and a base at the bottom of said passage wherein said passage is configured and dimensioned to support said container in said inverted orientation above said base.

7. A container inverting device as in claim 6, wherein said passage has a first end and second end, said base extending at least partially across said second end of said passage.

8. A container inverting device as in claim 7, wherein said base has a hole therein, said hole being smaller than said base of said passage, that prevents said container from extending entirely through said second end.

9. A container inverting device as in claim 1, wherein said passage comprises a side wall and a base at the bottom of said passage wherein said passage is configured and dimensioned to support said container above said base.

10. A container inverting device as in claim 9, wherein said passage has a first end and second end, said base extending at least partially across said second end of said passage.

11. A container inverting device, for a container having an opening, for supporting said container on a substantially vertical wall at an inverted orientation with respect to said container opening, said container opening being located, when in said inverted orientation, in a position lower than all other portions of said container, whereby, in said inverted orientation, material contained in said container flows toward said opening, said container inverting device comprising:

(a) a support member defining a passage for receiving a portion of said container adjacent said opening of said container, said passage being configured and dimensioned to support said container in said inverted orientation;

(b) a suction cup having a suction surface for engaging said substantially vertical wall, said suction cup being secured to and extending from a point of attachment on said support member for attaching said support member to said substantially vertical wall at a position which maintains said container in said inverted orientation; and (c) an abutting surface associated with said support member, said abutting surface being positioned on said support member and with respect to said suction cup to provide a separation distance between said support member and said substantially vertical wall, said separation distance being substantially equal to the distance between said point of attachment and said suction surface of said suction cup, while said suction cup is in a compressed suction gripping configuration, whereby said separation distance is sufficient to position said support member in an orientation where said suction cup is subjected to forces substantially parallel to said suction cup when said support member is maintained in a position where said container is in said inverted orientation, said abutting surface extending to provide support from a first position directly underneath said compressed suction cup across to a second position displaced from said first position, wherein said abutting surface is an elongated substantially horizontally oriented shoulder.

12. A container inverting device as in claim 11, wherein said abutting surface extends from said support member toward said substantially vertical wall, a distance substantially equal to the distance between said substantially vertical surface and said support member while said support member is attached thereto.

* * * * *